US005876258A

United States Patent [19]

Gray

[11] Patent Number: 5,876,258

[45] Date of Patent: Mar. 2, 1999

[54] SELF-ACTIVATING MARINE JET DRIVE WEED GRATE CLEANOUT SYSTEM

[75] Inventor: Charles F. Gray, Fond du Lac, Wis.

[73] Assignee: Brunswick Corporation, Lake Forest, Ill.

[21] Appl. No.: 867,546

[22] Filed: Jun. 2, 1997

[51] Int. Cl.[6] ..... B63H 11/01

[52] U.S. Cl. ..... 440/46; 440/38

[58] Field of Search ..... 440/38, 46, 47; 114/270; 60/221, 222

[56] References Cited

U.S. PATENT DOCUMENTS

| | | | |
|---|---|---|---|
| 3,253,567 | 5/1966 | Patton, Jr. | 440/46 |
| 3,279,414 | 10/1966 | Rabald | 440/46 |
| 3,343,368 | 9/1967 | Castoldi | 440/46 |
| 4,027,617 | 6/1977 | Ikeda et al. . | |
| 4,775,341 | 10/1988 | Tyler et al. . | |
| 5,224,887 | 7/1993 | Futaki . | |
| 5,234,361 | 8/1993 | Dickinson et al. . | |
| 5,577,941 | 11/1996 | Chartier . | |

OTHER PUBLICATIONS

Mercury Marine's Service Manual 90–824724, 1993, pp. 4A1–4A–35.

*Primary Examiner*—Ed L. Swinehart
*Attorney, Agent, or Firm*—Andrus, Sceales, Starke & Sawall

[57] ABSTRACT

A weed grate for a watercraft having a jet propulsion unit. The weed grate includes a plurality of cantilever tines each joined to a pivot rod. The cantilever tines extend across the inlet opening for the jet drive to prevent debris from entering through the water inlet opening. A spring member is mounted between the cantilever tines and a mounting frame such that the spring member provides an outward rotational bias force against the rotatable cantilever tines. During operation of the watercraft, if a mass of weeds becomes clogged in the cantilever tines, the upward and inward suction force of the jet drives causes the cantilever tines to rotate upward against the rotational bias force and allow the weeds to be ingested by the jet drive.

18 Claims, 4 Drawing Sheets

FIG. 1
PRIOR ART
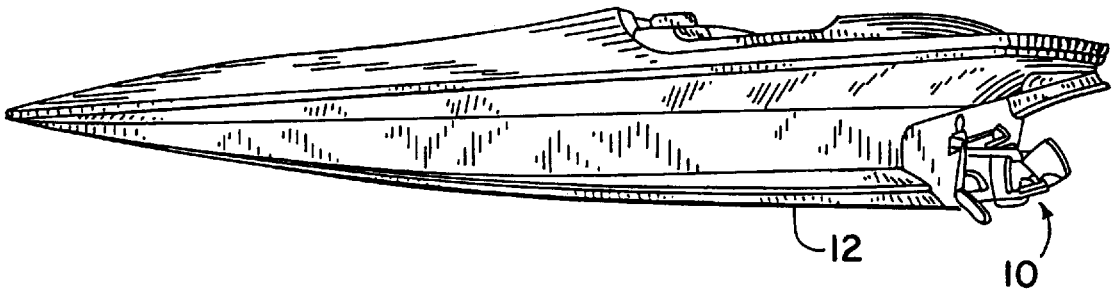
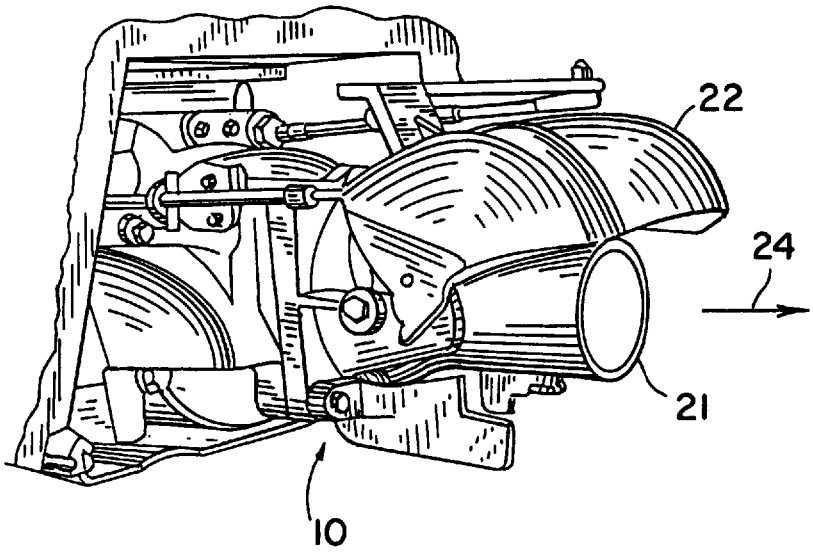
FIG. 2
PRIOR ART

FIG. 3
PRIOR ART
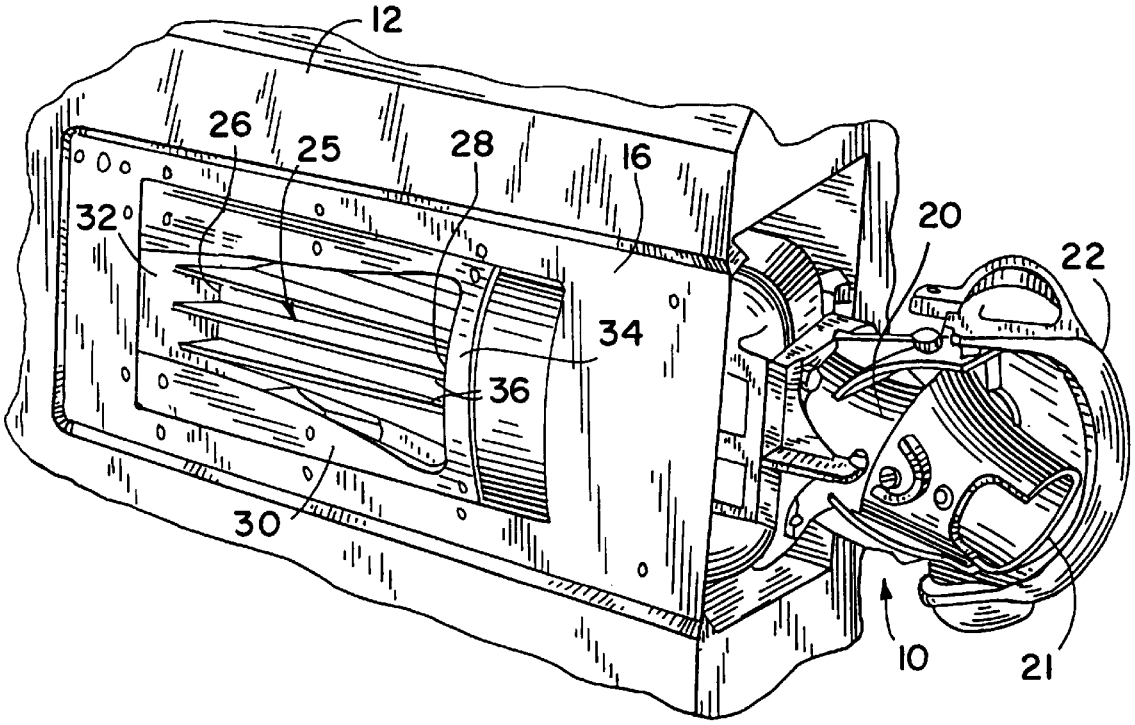
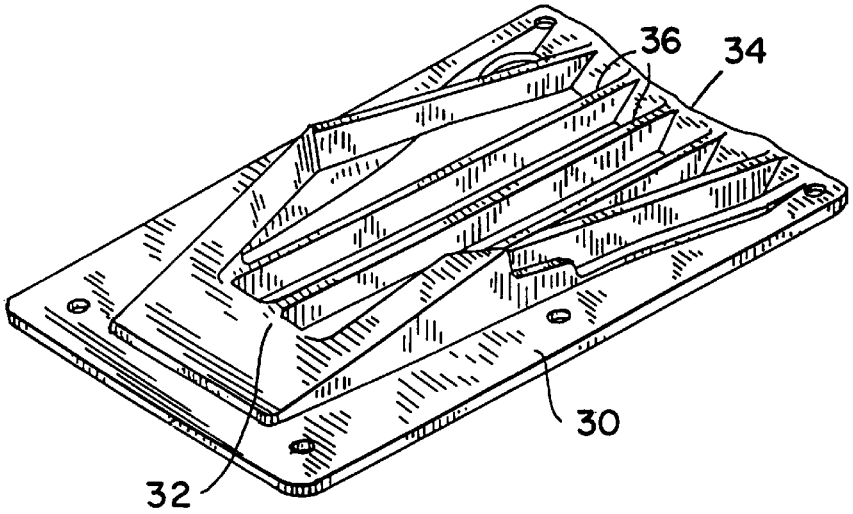
FIG. 4
PRIOR ART

FIG. 5
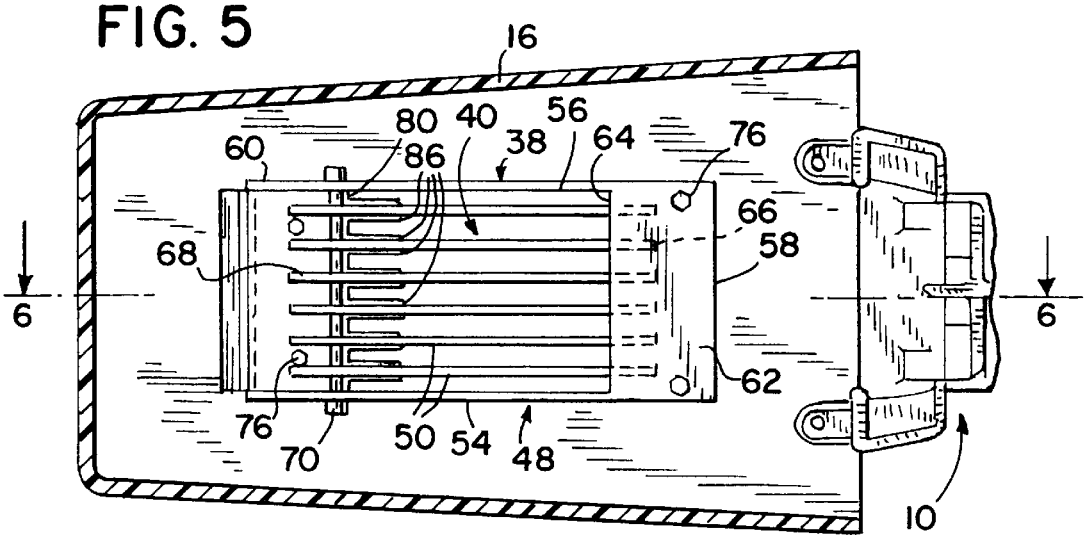
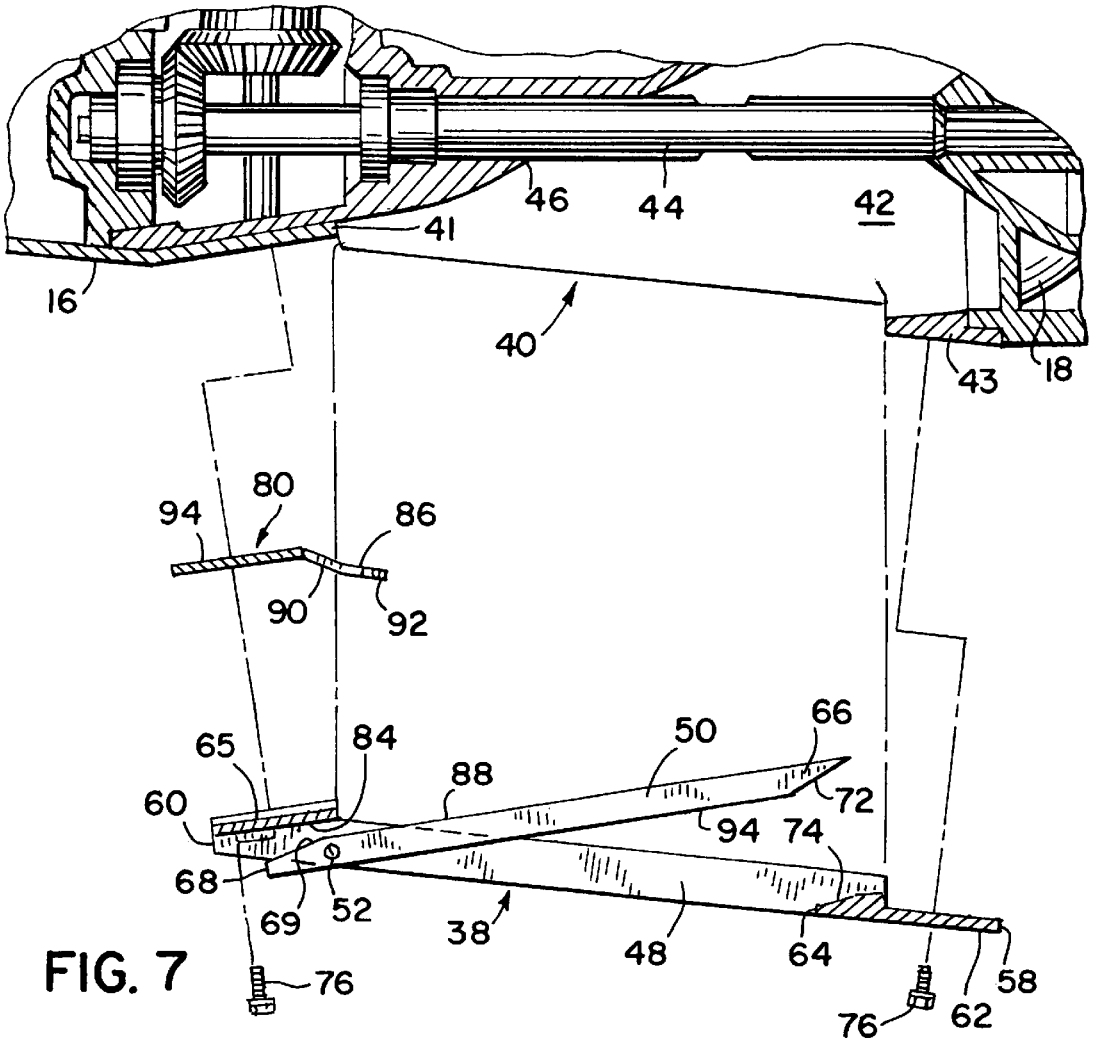
FIG. 7

SELF-ACTIVATING MARINE JET DRIVE WEED GRATE CLEANOUT SYSTEM

BACKGROUND OF THE INVENTION

The invention relates to marine jet drives. More particularly, the invention relates to a self-activating weed grate to be used on a marine jet drive that effectively allows the weed grate to be cleaned out during operation.

Jet propelled watercraft have a number of significant advantages over propeller-type watercraft. One of the advantages of jet propulsion units is that they permit the watercraft to be operated in very shallow bodies of water as compared to a conventional propeller-driven unit, since a jet propulsion unit does not include the lower unit and propeller of a conventional propulsion unit which extend below the hull of the boat.

Jet propulsion units for watercraft typically have an engine-driven jet pump located within an intake duct in the hull of the watercraft. An inlet opening through the underside of the watercraft allows seawater to flow to the pump in the intake duct. A water intake housing is adapted to the hull on the bottom of the watercraft and closes off the bottom of the watercraft while allowing seawater to pass through the inlet opening into the intake duct and to the jet pump. The jet pump generally consists of an impeller and a stator located within the intake duct followed by a nozzle. The impeller of the pump is driven by the engine, and provides energy to the flow of seawater to the pump. From the impeller, the seawater flows through the stator and the nozzle before exiting rearward through a vectored outlet to steer the watercraft (e.g., a generally tubular rudder that can rotate to steer the watercraft).

When operating a watercraft including a jet propulsion unit in shallow bodies of water, it is possible to ingest seaweed and other debris into the jet propulsion unit through the inlet opening. To prevent debris from entering through the inlet opening, a grate or screen is typically placed across the inlet opening.

Marine jet drive intake grates are known in the prior art. As mentioned, the intake grate or screen is provided across the water inlet opening of the jet propulsion unit to prevent large pieces of debris from being drawn into the jet propulsion unit and damaging the impeller and the various other internal components. During continuous use of the marine jet drive in relatively weedy areas, the large amount of floating weeds can cause the intake grate to become clogged. The suction created by the impeller causes weeds and debris to wrap around the tines of the intake grate and slide rearwardly along the tines, where the weeds become stuck at the juncture between the tines and the aft end of the intake grate. When a significant amount of weeds and other debris builds up, the dense mass prevents water from flowing through the intake grate into the jet drive. This reduced amount of water flow can cause the jet drive to stall and require the user to remove the weeds and debris caught in the intake grate.

One solution to the problem of weeds clogging the intake grate is shown in Chartier U.S. Pat. No. 5,577,941. In this patent, the individual tines of the intake grate have end tips which are spaced from the aft end of the intake grate by a pass-through gap. Thus, when weeds and debris become intertwined between the tines, the weeds are able to slide rearwardly along the tines and through the gap while the jet drive is operating. In this manner, the problem of clogging has been reduced. However, the size of the gap between the end tips of the tines and the aft end of the weed grate plate limits the size and amount of weeds that can pass through the gap and through the jet drive. Thus, large clumps of weeds which have a thickness greater than the gap between the tines and the aft end of the intake grate can cause clogging of the intake grate.

Therefore, it can be appreciated that a jet drive weed grate which prevents large debris from passing therethrough during normal operating conditions, while allowing weeds which begin to clog up the grate to pass through the jet drive would be a desirable improvement in the jet drive marine propulsion field.

SUMMARY OF THE INVENTION

The invention is a self-activating weed grate for a marine jet drive that allows weeds to flow therethrough while preventing large debris from entering the water intake duct.

The weed grate of the present invention includes a series of cantilever tines extending between the forward end and the aft end of the water intake. The aft end tip of each cantilever tine is positioned above the aft end of the mounting frame for the weed grate.

A pivot rod passes through the forward end of each cantilever tine and is pivotally mounted to the mounting frame. The pivot rod is positioned transversely of the water inlet opening in the intake housing and permits the cantilever tines to pivot up-wardly and inwardly into the water intake duct. In accordance with the invention, the aft end tips of the cantilever tines interact with a contact plate on the mounting frame to prevent the cantilever tines from rotating completely out of the inlet opening.

A spring member is positioned to contact each of the cantilever tines such that the spring member applies a rotational bias force on the tines which tends to rotate the aft end of each cantilever tine downward and outward with respect to the water inlet opening. The spring member includes a plurality of spring arms, each of which contact one of the cantilever tines to provide the rotational bias force. In a static position, the aft end tip of each cantilever tine is pressed against the contact plate by the rotational bias force. In this manner, during normal operating conditions, the cantilever tines prevent large objects from entering the water inlet opening.

When weeds become clogged in the cantilever tines, the suction force created by the jet drive becomes greater than the rotational force provided by the spring member. Thus, the cantilever tines rotate inwardly with respect to the water inlet opening, thereby creating a gap between the aft end tip of each cantilever tine and the contact plate. As the gap increases, weeds which have been clogged between the tines slide rearwardly along and then off of the cantilever tines and through the jet drive. Thus, the upward and inward rotation of the cantilever tines allows weeds to pass through the impeller and the remaining components of the marine jet drive.

Additionally, the spring member is selected such that at a selected engine speed, the suction force created by the impeller is strong enough to rotate the tines upward against the rotational bias force to create a gap between the aft end tips and the contact plate. Thus, at elevated engine speeds weeds are able to pass between the cantilever tines and the contact plate. This feature is desirable, since at higher speeds, the possibility of debris passing through the water inlet opening is greatly decreased as compared to low speed operation in shallow water.

DETAILED DESCRIPTION OF THE DRAWINGS PRIOR ART

FIG. 1 is a perspective view of a marine jet drive installed on a boat, as is known in the prior art.

FIG. 2 is an enlarged view showing the jet drive of FIG. 1 and illustrates forward drive.

FIG. 3 is an isometric view taken from below the jet drive of FIG. 2.

FIG. 4 is an isometric view from above of the intake grate of FIG. 3 disassembled from the jet drive, as is known in the prior art.

PRESENT INVENTION

FIG. 5 is a bottom view of a jet drive with a weed grate in accordance with the invention.

Figure 6:
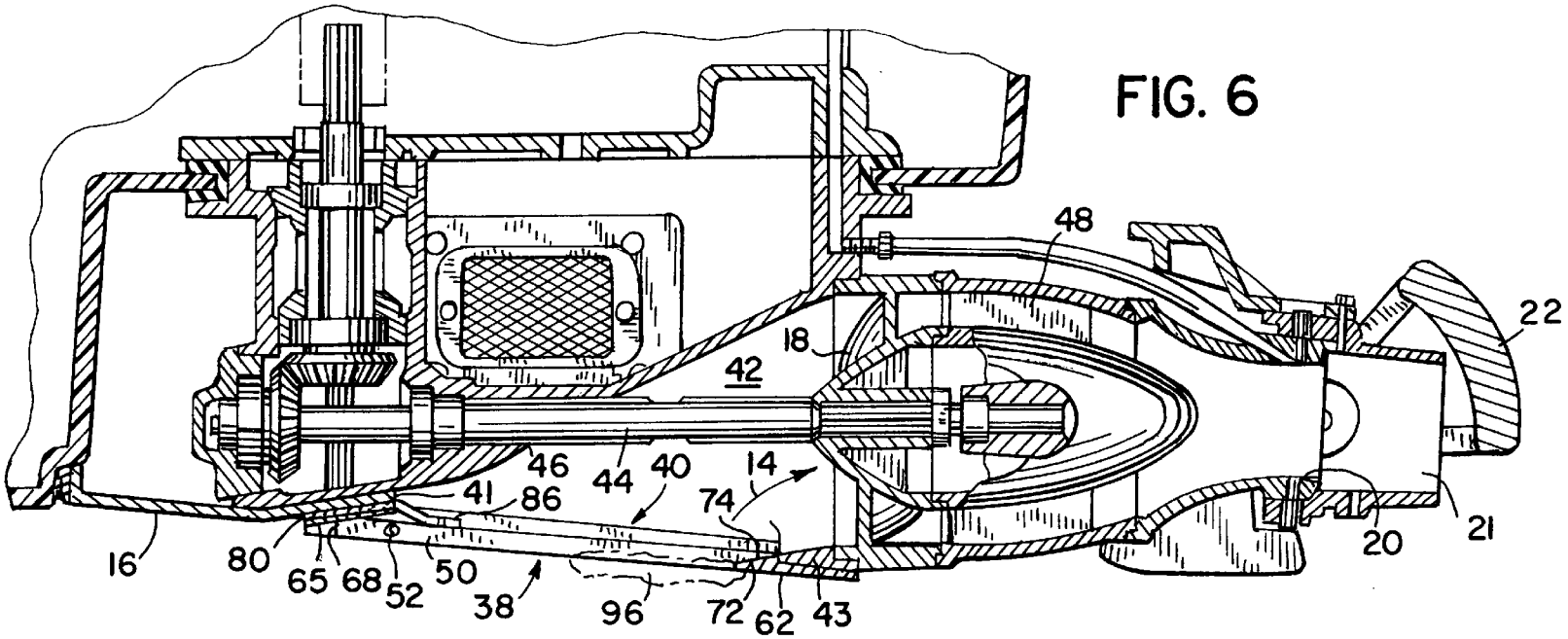

FIG. 6 is a sectional view taken along line 6—6 of FIG. 5.

FIG. 7 is an enlarged sectional view similar to FIG. 6, showing the method of attaching the weed grate to the water intake housing.

Figure 8:
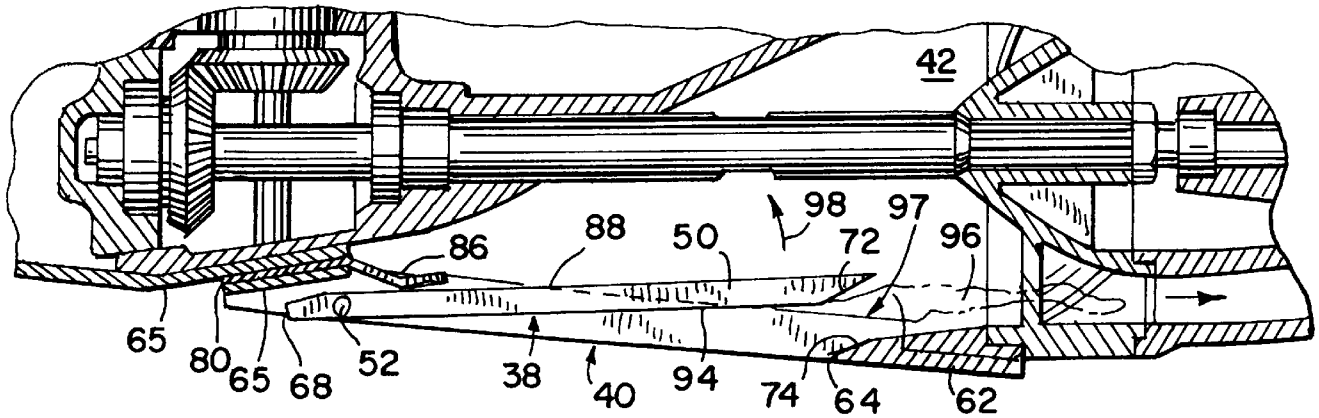

FIG. 8 is an enlarged sectional view similar to FIG. 6, showing the cantilever tines in a rotated position.

DETAILED DESCRIPTION OF THE INVENTION PRIOR ART

FIG. 1 shows a marine jet drive 10 mounted to a boat 12, as known in the prior art and for which further reference may be had to *Mercury Marine's Service Manual* 90–824724, 1993, pp.4A–1 through 4A–35. The jet drive 10 operates by drawing water into a water intake housing 16, as shown in FIG. 6 at arrow 14 in intake duct 42. The water is drawn in by a high speed impeller 18 and is propelled rearwardly through thrust nozzle 20. Water exiting nozzle 20 can be directed by a rotating rudder 21 that pivots about a vertical axis to steer the boat 12. FIG. 2 shows reverse bucket 22 in an upper position such that water thrust is in the direction shown at arrow 24, and the boat 12 moves in the forward direction, i.e. leftwardly in FIGS. 1 and 2. For the reverse direction of boat motion, reverse bucket 22 is moved downwardly such that water thrust is in the opposite direction and the boat moves in the opposite direction, i.e. rightwardly in FIG. 1. With a neutral position, reverse bucket 22 is moved partially downwardly to cover a portion of thrust nozzle 20 to balance the forward and reverse water thrust.

The jet drive 10 has a water inlet opening 25, FIG. 3, on the bottom of the boat 12. The water inlet opening 25 is defined by a forward end 26 and an aft end 28 and admits water upwardly and rearwardly therein. An intake grate 30 is provided by a plate mounted to the water inlet opening 25 and has forward and aft ends 32 and 34 with a plurality of tines 36 extending therebetween. Weeds and debris slide rearwardly along tines 36 and may become stuck where the tines meet the aft end 34 of the intake grate 30.

As can be seen in FIG. 4, each of the tines 36 of the intake grate 30 is securely fixed to both the forward end 32 and the aft end 34. As weeds become stuck in the tines, the upward and rearward flow of water through the intake grate 30 continues to hold the weeds in place while more and more weeds begin to accumulate. If enough weeds accumulate at the point where the tines 36 join the aft end 34 of the intake grate 30, the flow of water through the water inlet opening 25 becomes reduced until the amount of water exiting the thrust nozzle 20 becomes inadequate to produce enough forward thrust to move boat 12. To remedy the clogging of the intake grate 30, the boat user must physically remove the weeds from the intake grate 30 before the boat will operate properly. If the intake grate 30 becomes clogged off-shore, this may require the user to swim under the boat and remove the clogged weeds, a task which is inconvenient to say the least.

PRESENT INVENTION

In the present invention, FIGS. 5–8, a weed grate 38 is provided across the water inlet opening 40 contained in the water intake housing 16. The water intake housing 16 is mounted to the hull of boat 12 and closes off the bottom of the boat 12 while allowing water, such as seawater, to pass through the inlet opening 40. Inlet opening 40 is defined by a forward end 41 and an aft end 43 formed in the water intake housing 16. The inlet opening 40 provides a path for seawater to flow into an intake duct 42 located within the water intake housing 16. Seawater flows upwardly and rearwardly as shown at arrow 14 through the intake duct 42 to the impeller 18. The impeller 18 is rotatably driven by an impeller drive shaft 44. The impeller drive shaft 44 passes through an impeller drive shaft opening 46 in the water intake housing 16. Impeller 18 pushes the water rearwardly through a stator 47 which has several stationary vanes to remove swirl from the accelerated seawater. The flow area through the upstream portion of the stator 47 is preferably constant, but decreases continuously through the aft portion of the stator 47 and through the nozzle 20. There is thus an increase in speed of the water as it flows through the stator 47 and the nozzle 20.

The weed grate 38 of the invention includes a mounting frame 48 and a series of cantilever tines 50 rotatably connected to the mounting frame by a pivot rod 52. As can best be seen in FIG. 5, the mounting frame 48 includes a pair of lateral side supports 54 and 56 which extend between and are joined to the aft end 58 and forward end 60 of the mounting frame 48. The mounting frame 48 includes a rear contact plate 62 which extends between each of the side supports 54 and 56 at the aft end 58 of the mounting frame 48. The contact plate 62 includes a leading edge 64 which defines the aft end of the inlet opening 40 when the mounting frame 48 is mounted to the water intake housing 16. The mounting frame 48 also includes a cross support member 65, FIG. 7, extending between and connected to each of the side supports 54 and 56 at the forward end 60 of the mounting frame 48.

Each of the plurality of cantilever tines 50 has an aft end 66 and a forward end 68. As can be seen in FIG. 7, the pivot rod 52 passes through and is securely joined to each of the cantilever tines 50 near the forward end 68 of the tine 50. Cantilever tines 50 each include an angled upper surface 69 tapering upwardly and inwardly from the forward end 68. In the preferred embodiment of the invention, each of the cantilever tines 50 is welded to the pivot rod 52, such that the plurality of cantilever tines 50 and the pivot rod 52 form a single unit.

The pivot rod 52 extends transversely between and through each of the side supports 54 and 56 of the mounting frame 48. The ends of the pivot rod 52 are pivotally supported by the side supports 54 and 56 such that the cantilever tines 50 are allowed to pivot relative to the fixed mounting frame 48. The ends of the pivot rod 52 extend through respective openings in the side supports 54 and 56 and press-fit caps 70 and 71 on the ends of the pivot rod 52 retain the latter in place. As can be appreciated in FIGS. 5–8, the length of the cantilever tines 50 from the pivot rod 52 to the aft end 66 is less than the distance between the pivot rod 52 and the leading edge 64 of the contact plate 62. Thus, the pivoting movement of the cantilever tines 50 about the pivot rod 52 is limited in the outward and downward direction away from the intake duct 42 by the leading edge 64 of the contact plate 62. Specifically, a tapered end tip 72 contained on the aft end 66 of each cantilever tine 50 contacts an angled upper surface 74 formed on the contact plate 62. The physical contact between the tapered end tips 72 and the upper surface 74 prevents the cantilever tines 50 from rotating outwardly past the leading edge 64 of the contact plate 62.

Referring now to FIG. 7, the mounting frame 48 is securely connected to the water intake housing 16 by a plurality of connectors such as bolts 76. A pair of bolts 76 pass through a pair of openings in the contact plate 62 near the aft end 58 of the mounting frame 48 and are received in a pair of internally threaded bores (not shown) contained in the aft end 43 of the water intake housing 16. Likewise, a pair of bolts 76 pass through a pair of openings in the cross support member 65 connected between the pair of lateral side supports 54 and 56. The pair of bolts 76 passing through the cross support member 65 are received in a pair of internally threaded bores (not shown) contained in the forward end 41 of the water intake housing 16. In the manner, the mounting frame 48the mounting frame 48 is securely mounted in the housing 16.

A spring member 80, FIG. 7, is mounted between the cross support member 65 of the mounting frame 48 and the forward end 41 of the water intake housing 16. The pair of bolts 76 securing the cross support member 65 to the forward end 41 of the water intake housing 16 pass through the spring member 80 such that the spring member 80 is securely connected between the cross support member 65 and the forward end 41 of the water intake housing 16. The cross support member 65 includes a sloped surface 84 which aids in reducing the drag of the weed grate 38.

The spring member 80 includes a plurality of spring arms 86. As best seen in FIG. 5, the spring member 80 includes the same number of spring arms 86 as cantilever tines 50, such that when the spring member 80 is mounted to the mounting frame 48, one of the spring arms 86 contacts the flat upper surface 88 of each cantilever tine 50.

Referring again to FIG. 7, each of the spring arms 86 includes an angled flexing portion 90, a contact portion 92 and a connecting portion 94. The spring member 80 is connected to the mounting frame 48 under stress such that the flexing portion 90 of each spring arm 86 exerts a rotational bias force on each of the cantilever tines 50. This rotational bias force urges the cantilever tines 50 to rotate downwardly and outwardly away from the inlet opening 40, thereby causing the angled end tips 72 to contact the upper surface 74 of the contact plate 62. The interaction between the angled end tips 72 and upper surface 74 limits the amount of rotation of the cantilever tines 50 due to the rotational bias force exerted by the spring member 80. In this manner, the spring member 80 causes the angled end tips 72 to be held against the angled upper surface 74 of the contact plate 62 to prevent debris from entering the inlet opening 40, as shown in FIG. 6.

In the preferred embodiment of the invention, the spring member 80 is constructed of a metallic material, such as spring steel. For example, the spring member 80 could be formed of stainless steel. The amount of rotational bias force exerted by the spring member 80 on the cantilever tines 50 is determined, inter alia, by the type of metal selected for the spring member 80 and the angle of the flexing portion 90 relative to the connecting portion 94. If a greater amount of rotational bias force is required, the angle between the flexing portion 90 and the connecting portion 94 can be decreased, such that when the spring member 80 is connected to the mounting frame 48, the spring arms 86 are bent further inwardly. This calibrates the amount of rotational bias force exerted by spring member 80.

Referring now to FIGS. 6 and 8, the operation of the weed grate 38 will be described. During low speed engine operation, the impeller 18 is rotated by the propeller drive shaft 44 at a low rate of speed. The rotating impeller 18 creates an area of low pressure which acts to suck water upwardly and inwardly through the water inlet opening 40, as shown by arrow 14. At low speeds, the outward rotational bias force provided by the spring member 80 is greater than the inward and upward force of the water against the relatively small surface area of the lower surface 94 of each cantilever tine 50. Thus, at low speeds, the angled end tip 72 of each cantilever tine 50 is pressed into contact with the upper surface 74 of the contact plate 62, thereby preventing debris from entering the intake duct 42 through the water inlet opening 40. This is particularly advantageous, since at low engine speeds, the boat 12 is often operated in shallow water, increasing the chance that solid debris, such as rocks, may contact the weed grate 38. Therefore, it is desirable that the cantilever tines 50 be held in the outwardmost position, FIG. 6, in shallow water to prevent solid debris from entering the intake duct 42.

When a large number of weeds 96 become lodged across the cantilever tines 50 at the junction between the cantilever tines 50 and the contact plate 62, the build-up of weeds 96 causes a decrease in the amount of water entering the intake duct 42. As the weeds 96 begin to accumulate, the suction force created by the impeller 18 pulls the weeds 96 upwardly against the lower surface 94 of the tines 50. Once enough weeds 96 accumulate, the suction force created by the impeller 18 acts on the increased surface area of the weeds 96 to cause the cantilever tines 50 to rotate inwardly as shown by arrow 98 against the rotational bias force of spring member 80. The upward rotation of the cantilever tines 50 creates a gap 97 between the angled end tips 72 and the upper surface 74 of the contact plate 62. This gap 97 permits the weeds 96 to flow between the end tips 72 and upper surface 74 and be ingested by the rotating impeller 18. The rotating impeller 18 causes the weeds to be sliced into small pieces and expelled through the nozzle 20. In this manner, the weeds 96 which begin to clog the weed grate 38 are automatically removed and ingested by the jet drive 10.

Additionally, when the engine speed, and thus the rotational speed of the impeller 18, increases to a desired value, the upward and inward force of water against the lower surface 94 of the cantilever tines 50 exceeds the outward rotational bias force provided by the spring member 80. Thus, as the engine speed increases, gap 97 begins to form between the angled end tips 72 and the upper surface 74 of the contact plate 62. As the gap 97 forms, weeds 96 contacting the weed grate 38 are immediately ingested by the impeller 18. At higher engine speeds, the jet boat is typically operated in deeper water, where the chances of solid debris being ingested by the intake duct 42 is greatly decreased, thereby decreasing the chances that solid debris would contact the impeller 18.

Although the present invention has been described as having a spring member 80 including a plurality of spring arms 86, the spring member 80 could be replaced by various alternatives, such as a torsion spring surrounding the pivot shaft 52. Such a torsion spring would provide the required rotational bias force which is presently provided by the spring member 80.

It is recognized that various equivalents, alternatives, and modifications are possible within the scope of the appended claims.

I claim:

1. A marine jet drive weed grate for a water inlet opening of a jet drive, the inlet opening having a forward end and an aft end and admitting water upwardly and rearwardly therein, the weed grate comprising:

a pivot rod mounted across the inlet opening near the forward end of the inlet opening;

a plurality of cantilever tines each having a forward end and an aft end, each tine being mounted to the pivot rod near its forward end such that the aft end of each tine is movable relative to the aft end of the inlet opening; and a spring member exerting a rotational bias force to pivot the tines in a downward direction toward the aft end of the inlet opening, such that when weeds begin to clog the weed grate, suction created by the jet drive causes the tines to rotate upwardly against the rotational bias force of the spring member to create a gap between the tines and the aft end of the inlet opening to permit weeds to pass through the inlet opening.

2. The weed grate of claim 1 wherein each of the cantilever tines has an aft end tip movable into and out of contact with the aft end of the inlet opening, and wherein downward rotation of the tines past the aft end of the inlet opening is prevented by said contact.

3. The weed grate of claim 1 wherein the spring member has one or more spring arms contacting the cantilever tines.

4. The weed grate of claim 1 wherein the spring member has a flexing portion and a connecting portion having an angle therebetween controlling the amount of rotational bias force exerted by the spring member.

5. The weed grate of claim 4 wherein the angle between the connecting portion and the flexing portion is selected such that suction created by the jet drive causes the tines to rotate upward and overcome the rotational bias force when the speed of the jet drive reaches a desired level.

6. A marine jet drive weed grate for the water inlet opening of a jet drive, the inlet opening admitting water upwardly and rearwardly therein, the weed grate comprising:

a stationary mounting frame adapted to be mounted in the inlet opening, the mounting frame having a forward end, an aft end, and a contact plate extending across the mounting frame near the aft end;

a pivot rod mounted across the mounting frame near the forward end of the mounting frame;

a plurality of cantilever tines each having a forward end and an aft end, each tine being mounted to the pivot rod near its forward end such that the aft end of each tine is movable relative to the contact plate of the mounting frame; and a spring member exerting a rotational bias force to pivot the tines in a downward direction such that the aft end of each cantilever tine rotates toward the contact plate of the mounting frame, such that when weeds begin to clog the weed grate, suction created by the jet drive causes the tines rotate upward against the rotational bias force of the spring member to create a gap between the tines and the contact plate of the mounting frame to permit the weeds to pass through the inlet opening.

7. The weed grate of claim 6 wherein each of the tines has a tapered aft end tip, and wherein the spring member causes the aft end tip of each tine to contact the contact plate of the mounting frame to prevent further downward rotation of the tines.

8. The weed gate of claim 7 wherein the contact plate has an upper surface angled upwardly from a leading edge of the contact plate such that the rotational bias force causes the tapered aft end tip of each tine to contact the upper surface of the contact plate.

9. The weed grate of claim 6 wherein the spring member has one or more spring arms contacting the tines.

10. The weed grate of claim 6 wherein the spring member has a plurality of spring arms, wherein one of the spring arms contacts each of the tines.

11. The weed grate of claim 6 wherein the spring member has a calibrated flexing portion controlling the amount of rotational bias force exerted by the spring member.

12. The weed grate of claim 11 wherein the spring member is calibrated such that suction created by the jet drive causes the tines to rotate upward and overcome the rotational bias force when the speed of the jet drive reaches a desired level.

13. A marine jet drive weed grate for the water inlet opening of a jet drive, the inlet opening having a forward end and an aft end and admitting water upwardly and rearwardly therein, the weed grate comprising:

a stationary mounting frame adapted to be mounted in the inlet opening, the mounting frame having a forward end, an aft end, and a contact plate extending across the mounting frame near the aft end, the contact plate having an upper surface angled upwardly from a leading edge of the contact plate;

a pivot rod mounted across the mounting frame near the forward end of the mounting frame;

a plurality of cantilever tines each having a forward end, an aft end, and an aft end tip, each tine being mounted to the pivot rod near its forward end such that the aft end of each tine is movable relative to the contact plate of the mounting frame; and a spring member exerting a rotational bias force to pivot the tines in a downward direction toward the contact plate of the mounting frame, such that the aft end tip of each cantilever tine is biased into contact with the upper surface of the contact plate, and such that when weeds begin to clog the weed grate, suction created by the jet drive causes the tines to rotate upwardly against the rotational bias force of the spring member to create a gap between the aft end tips of the tines and the upper surface of the contact plate of the mounting frame to permit the weeds to pass through the gap.

14. The weed grate of claim 13 wherein the spring member has a flexing portion and a connecting portion having an angle therebetween controlling the amount of rotational bias force exerted by the spring member.

15. The weed grate of claim 14 wherein the angle between the connecting portion and the flexing portion is selected such that suction created by the jet drive causes the tines to rotate upwardly and overcome the rotational bias force when the speed of the jet drive reaches a desired level.

16. A weed grate for a water inlet opening of a jet drive, comprising:

a pivot rod mounted across a first side of the opening;

a plurality of tines each having a first end attached to the pivot rod and a second end extending away from the pivot rod and across the opening toward a second side of the opening; and a spring member in force transmitting relation with the plurality of tines to urge the tines toward a closed position across the opening and into contact with the second side of the opening, the force transmitted by the spring member being sufficiently large to maintain the tines in the closed position when the opening is not covered by an obstruction, the force transmitted by the spring member being sufficiently small to be overcome by a suction force created by the jet drive when the opening is at least partially covered by the obstruction.

17. The weed grate of claim 16 wherein the first side of the opening is at a forward end of the opening relative to the intended direction of movement of the jet drive, and the second side of the opening is at an aft end of the opening relative to the intended direction of movement of the jet drive.

18. The weed grate of claim 16 wherein the spring member comprises a sheet of spring steel having a plurality of fingers, each of the plurality of fingers being associated in force transmitting relation with one of the plurality of tines.

* * * * *